US008667870B2

(12) United States Patent
Teper

(10) Patent No.: US 8,667,870 B2
(45) Date of Patent: Mar. 11, 2014

(54) MULTI TORQUE LIMITING DRIVER

(76) Inventor: Boris R. Teper, Farmington Hills, MI (US)

( * ) Notice: Subject to any disclaimer, the term of this patent is extended or adjusted under 35 U.S.C. 154(b) by 345 days.

(21) Appl. No.: 12/831,750

(22) Filed: Jul. 7, 2010

(65) Prior Publication Data

US 2011/0132153 A1 Jun. 9, 2011

Related U.S. Application Data

(60) Provisional application No. 61/266,221, filed on Dec. 3, 2009.

(51) Int. Cl.
*B25B 13/00* (2006.01)

(52) U.S. Cl.
USPC ..... 81/124.4; 81/177.2; 81/467; 81/478; 81/183

(58) Field of Classification Search
USPC ..... 81/467, 472, 477, 478, 481, 483, 81/DIG. 5, 177.2; 7/138
See application file for complete search history.

(56) References Cited

U.S. PATENT DOCUMENTS

| | | | | | |
|---|---|---|---|---|---|
| 64,662 | A * | 5/1867 | Gold | 7/138 |
| 3,633,445 | A * | 1/1972 | Aijala | 81/481 |
| 3,893,354 | A * | 7/1975 | Knoll | 81/483 |
| 4,070,932 | A * | 1/1978 | Jeannotte | 81/177.2 |
| 4,488,461 | A * | 12/1984 | Hurtig | 81/98 |
| 4,729,281 | A * | 3/1988 | Holloway, Jr. | 81/177.2 |
| 5,109,737 | A * | 5/1992 | Raber | 81/177.2 |
| 5,285,702 | A * | 2/1994 | Hillinger | 81/177.2 |
| 6,138,539 | A | 10/2000 | Carchidi et al. | |
| 6,162,053 | A * | 12/2000 | Hollander | 433/141 |
| 6,370,990 | B1 * | 4/2002 | Lin | 81/177.2 |
| 6,487,943 | B1 | 12/2002 | Jansson et al. | |
| 6,662,693 | B2 | 12/2003 | Hu | |
| 6,752,051 | B2 | 6/2004 | Hu | |
| 6,766,717 | B2 | 7/2004 | Hu | |
| 7,383,756 | B1 | 6/2008 | Liu | |
| 7,481,139 | B2 * | 1/2009 | Hsieh | 81/478 |
| 2005/0217436 | A1 * | 10/2005 | Wolf | 81/124.4 |
| 2005/0268751 | A1 * | 12/2005 | Buchanan | 81/64 |

OTHER PUBLICATIONS

Mountz MC14 catalog 2008; MTBN Break-Over Torque Wrench Internally Preset MTBN 03.6; MMTB Miniature Break-Over Wrench with Fixed Heads MMTB 03.7; TBIH Break-Over Wrench Interchangeable Head Style TBIH 03.8; TB Break-Over Wrench with Fixed Heads TB 03.9.

* cited by examiner

*Primary Examiner* — Alicia Torres
(74) *Attorney, Agent, or Firm* — :Fraser Clemens Martin & Miller LLC; William J. Clemens

(57) ABSTRACT

A torque driver includes a driver arm with a pivot mounting hole formed adjacent one end, a driver spindle mounting slot or sockets spaced from the pivot mounting hole providing multiple mounting positions for retaining the driver spindle, and a locking detent. A locking element engages the locking detent, a load applicator generates a selected load onto the locking element, and a handle is pivotally attached to the driver arm at the pivot mounting hole and has finger groove for applying a tightening force. The locking detent, the locking element and the load applicator cooperate to permit relative movement between the driver arm and the handle when the tightening force applied at the finger groove is at a predetermined value.

19 Claims, 11 Drawing Sheets

MULTI TORQUE LIMITING DRIVER

CROSS-REFERENCE TO RELATED APPLICATION

This application is entitled to the benefit of, and claims priority to, provisional patent application Ser. No. 61/266,221 filed Dec. 3, 2009, the entire disclosure of which is incorporated herein by reference.

BACKGROUND OF THE INVENTION

The present invention relates generally to an apparatus and method for tightening fasteners with torque limiting.

In the course of many mechanical assembly operations, it is important to tighten a fastener with a specified torque, so that the optimal potential of the fastener is utilized and/or overload of parts fastened together is prevented in order to avoid danger of damage to either the parts or the fastener itself. One example of such operation, where correct tightening of the fasteners is of great importance, is the mounting of optical scopes into scope rings. It is common knowledge that the scope ring fasteners should be tightened to strictly controlled values. Exceeding these values may cause damage to the thin wall scope bodies, while a smaller than required tightening torque applied to the fasteners may result in insufficient clamping force, which, in turn, may cause movement of the scope under force of firearm recoil, with the loss of the preset scope setting as the direct result of such scope movement relative to the rings.

It has been known to use special torque-limiting or torque setting devices, such as adjustable or pre-set torque drivers of different configurations. While adjustable torque drivers allow the user to set up such devices to desired tightening torque values using a mechanically based scale normally incorporated into such device, these devices suffer from certain inconsistency and relatively low repeatability of the same settings, as the human eye is often not capable of precisely identifying the same spot on the relatively low resolution scale typical for such mechanical devices. In addition, the vast majority of such devices are based on the use of "cam-over" and "slip clutch" systems and precision springs, which must be manufactured with a high degree of accuracy to assist in maintaining precision and consistency of the torque driver. As a consequence of having precision parts, such devices may be expensive and may also require labor intensive calibration. An example of such device is shown in U.S. Pat. No. 7,383,756. While an adjustable torque driver can be made with a digital readout, which improves resolution of the scale, and may utilize a load cell as a torque registering element instead of the mechanically based click-clutch system, the cost of such a digital adjustable torque driver is relatively high, which limits its use.

Pre-set torque drivers, for example the one shown in U.S. Pat. No. 6,662,693 typically have much simpler construction and lower cost, but are only able to deliver a single fixed torque setting, although, despite more simple construction, with a higher degree of precision and consistency in comparison with the adjustable torque driver. This driver design is typically not intended to be re-adjusted by the user, and therefore, can only deliver a single factory pre-set torque limiting value.

The single setting limitation is also considered to be a certain weakness by the users, who may often need to use more than one pre-set torque driver to cover the need for several fastening applications requiring at least several fixed torque settings, in which case the cost to the user to own these tools becomes considerable.

Another known pre-set "break-over" torque driver design, for example the one shown in Mountz, Inc. Catalog section 3.6-3.9, or described by U.S. Pat. No. 6,138,539, possesses high accuracy potential and capability to be used in difficult to reach places, along with availability of certain adjustments by the user, which can be realized thru adjustment of the internal compression type spring. However, in order to guarantee the accuracy of adjustment, this type of pre-set torque driver, which has no adjustment scale, must be set up with the additional use of a torque analyzer. In addition, even with this capability to be set up to the new torque limiting value, this design can still deliver only one torque setting between adjustments, and the need to use a torque analyzer makes practical implementation of this driver very expensive for the user. While the manufacturer offers a selection of pre-set driver handles, which can be switched to obtain different torque limiting settings without the use of a torque analyzer, the cost of the base "break-over" type torque driver combined with the need to have several optional handles remains quite high for the user.

Therefore, it would be beneficial to propose a torque tightening method and also, an improved configuration of the torque driver capable of delivering more than one consistent and highly repeatable fixed torque setting for tightening the fasteners. It would be also very beneficial if such torque driver design would allow certain torque setting adjustment capability, but in combination with a simple, easy to manufacturer and low cost design.

SUMMARY OF THE INVENTION

The present invention concerns a torque driver which incorporates a handle, a driving arm with multiple driver spindle attachment sockets formed within the arm at specified distances from the force application spot on the handle, means of locking the handle to the arm in order to provide a force sensitive lever to apply the tightening torque, and means of pivoting the handle relative to the arm.

The same torque driver may also incorporate means of tightening torque limit adjustment by use of a handle knob with an adjustment screw and related scale markings instead of a separate adjustment screw utilized for the fixed (preset) tightening torque set up. Alternatively, a driving arm can be configured to provide means and an appropriate scale for continuous adjustment of the driver spindle position relative to the force application spot on the handle, effectively creating an adjustable torque driver, in which the tightening torque is set by simply changing the above mentioned distance, but still using the fixed (preset) tightening force. If desired, such configuration can be further enhanced by means of providing the adjustable tightening force, as described above, creating the design with an extremely high range of adjustability both by the user set tightening force and the variable user set distance between the driver spindle and force application spot on the driver handle.

A method of providing multiple fixed torque settings in a driver with a fixed (preset) handle release force is based on the potential of the driver arm to accept a driver spindle at the different distances from the tightening force application spot on the handle. Therefore, the tightening torque, or moment of force applied to the fastener, is determined by the preset release force of the handle relative to the arm in combination with the distance between the driver spindle and the force application spot on the handle. This distance is selected by mounting the driver spindle in one of the appropriate driver spindle sockets within the arm, or by other means provided to continuously adjust and secure the position of the driver spindle relative to the force application spot on the handle.

Operation of the proposed torque driver is based on the principle of applying a specified force by use of the pivotable handle at varying length levers from the axis of driver rotation. Upon reaching a specified force, which corresponds to specified torque, a locking element of the handle disengages from a corresponding locking detent of the driving arm, which, in turn, causes the handle to rotate in the direction of the applied force to an angle relative to the arm, sufficient for effective cancellation of the torque action of the driver, thus preventing further fastener tightening.

While use of the pivotable handle may be considered to be an element of the known art, specifically of the "break-over" torque driver, an ability to change the tightening torque by simply mounting the driver spindle at varying distances from the tightening force application spot creates an opportunity to deliver multiple pre-set tightening torque settings without need for the user to do an adjustment and to use expensive torque analyzer devices, or to acquire any additional components in order to be able to change torque tightening settings.

The torque driver apparatus according to the invention comprises: a driver arm having a pivot mounting hole formed adjacent one end, a driver spindle mounting means spaced from said pivot mounting hole, said driver spindle mounting means having at least two mounting positions for retaining the driver spindle and transfer fastener tightening torque to a fastener, and a locking detent formed at said one end; a locking element engaging said locking detent; a load applicator generating a selected load onto said locking element; a handle having a finger groove formed therein, said handle being pivotally attached to said driver arm at said pivot mounting hole wherein said finger groove is spaced from said pivot mounting hole and said at least two mounting positions are at different distances from said finger groove; and whereby said locking detent, said locking element and said load applicator cooperate to prevent relative movement between said driver arm and said handle when a tightening force applied at said finger groove is less that a pre-determined value and cooperate to permit relative movement between said driver arm and said handle when the tightening force applied at said finger groove is at said pre-determined value.

The torque driver apparatus according to the invention also comprises: a driver arm having a pivot mounting hole formed adjacent one end, a driver spindle mounting means spaced from said pivot mounting hole, said driver spindle mounting means having at least two different positions for retaining a driver spindle and transferring fastener tightening torque to a fastener, and a locking detent formed at said one end; a locking element engaging said locking detent; a compression spring having a first end engaging said locking element and generating a selected load onto said locking element; a load transfer element engaging a second end of said compression spring; a handle having a finger groove formed therein, said handle being pivotally attached to said driver arm at said pivot mounting hole wherein said finger groove is spaced from said pivot mounting hole and said at least two mounting positions are at different distances from said finger groove; and an adjustment screw engaging said load transfer element for selectively compressing said compression spring to select the load whereby said locking detent, said compression spring and said load applicator cooperate to prevent relative movement between said driver arm and said handle when a tightening force applied at said finger groove is less that a pre-determined value associated with the selected load and cooperate to permit relative movement between said driver arm and said handle when the tightening force applied at said finger groove is at said predetermined value.

DESCRIPTION OF THE DRAWINGS

The above as well as other advantages of the present invention will become readily apparent to those skilled in the art from the following detailed description of a preferred embodiment when considered in the light of the accompanying drawings in which.

DESCRIPTION OF THE PREFERRED EMBODIMENT

Figure 1:
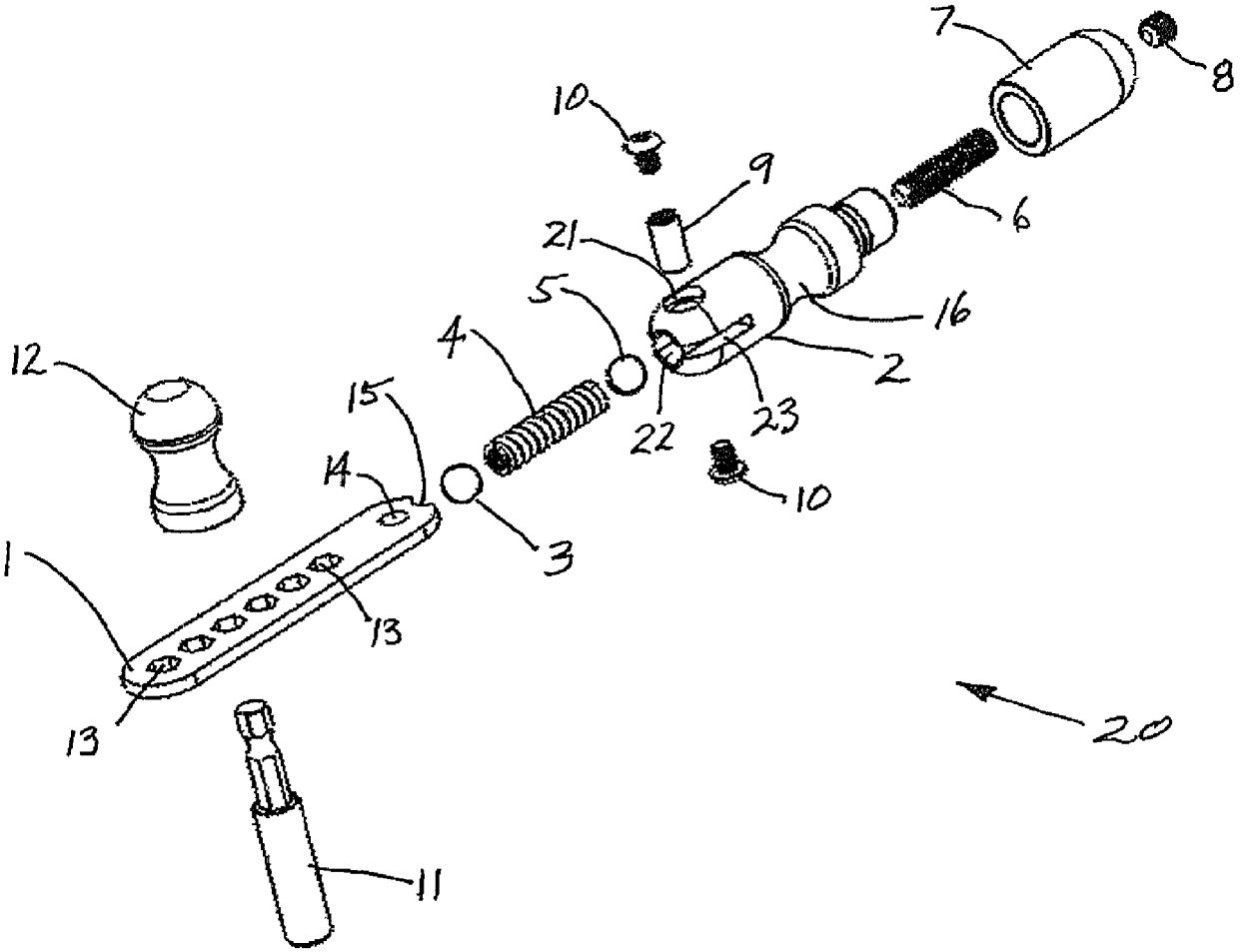
FIG. 1 is an exploded perspective view of an adjustable combination torque driver in accordance with the present invention.

The present invention concerns a torque driver 20 (FIG. 1) that includes a driver arm 1 with at least two driver spindle sockets 13 (an arm with a total of six sockets is shown), positioned at specified distances from an arm pivot mounting hole 14, and a locking detent 15 of either symmetrical (shown) or asymmetrical configuration (not shown), positioned at a specified distance from the arm pivot mounting hole 14. An arm handle 2 has a tightening force application spot 16 positioned at a specified distance from a handle pivot mounting hole 21, and means of accommodating related elements of an arm-to-handle locking system and locking system adjustment. A locking element 3 is shaped as a ball as shown. A locking element load applicator 4 is formed as a coiled compression spring. A load transfer element 5 is shaped as a ball. A load adjustment element 6 is formed as a screw.

Figure 6:
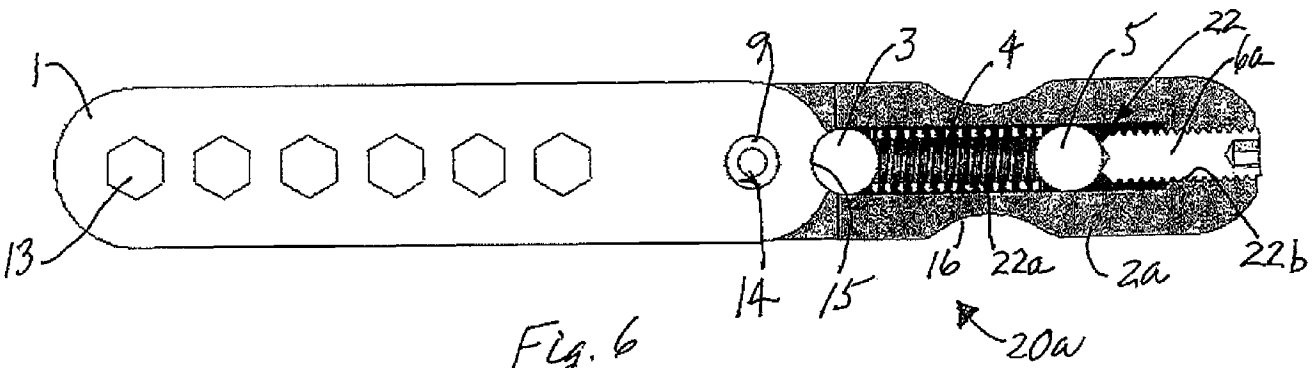
FIG. 6 is a view similar to FIG. 5 with the handle cut away.

Other elements of the torque driver 20 are a load adjustment element knob 7, a load adjustment knob position lock element 8 formed as a screw, a cylindrical pivot element 9 internally threaded at both ends, a pair of pivot retainers 10 formed as screws, a driver spindle 11, and a driver spindle retaining knob 12. The arm handle 2 has the hole 21 formed as a through aperture that extends traverse to a longitudinally extending bore 22 in the handle. As shown in FIG. 6, the bore 22 has a larger diameter portion 22*a* that retains the spring 4 between the ball 3 and the ball 5. The ball 5 is positioned adjacent an inner end of the portion 22*a* and the ball 3 is exposed at an opposite open end of the portion 22*a*. The bore 22 has a smaller diameter portion 22*b* that threadably retains the screw 6*a* used to set the value of the load applied by the spring 4.

Figure 4:
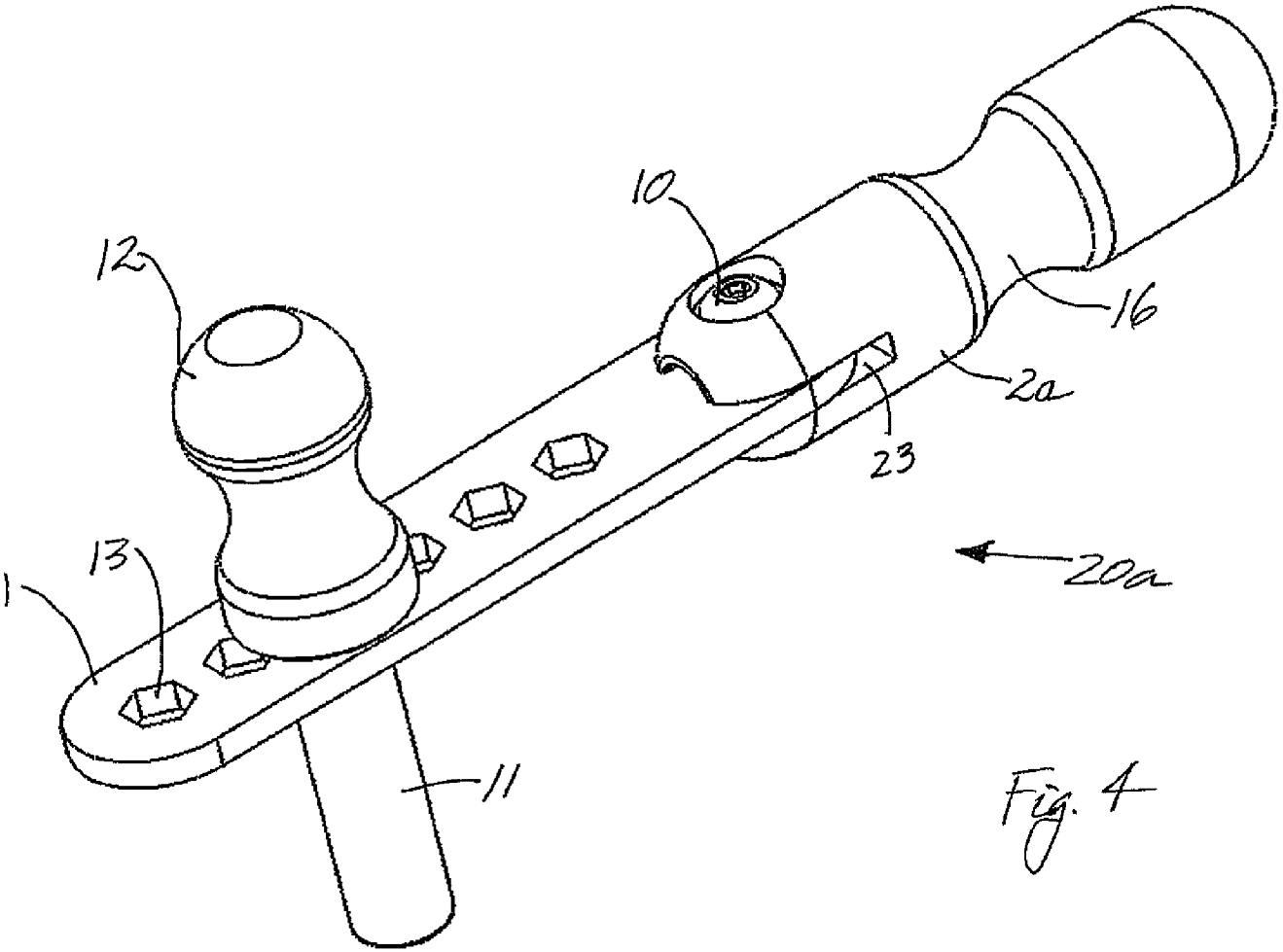
FIG. 4 is a perspective view of the apparatus shown in FIG. 2 assembled for use.

The arm handle 2 also has a slot 23 formed therein extending in a plane transverse to the longitudinal axis of the aperture 21 and centered on the longitudinally extending bore 22. As shown in FIG. 4, the end of the arm 1 having the detent 15 is inserted in the slot 23 with the mounting hole 14 aligned with the aperture 21. The pivot element 9 is inserted into the aperture 21 and the mounting hole 14 and is retained by the screws 10. Thus, the arm 1 can pivot on the pivot element 9 in the plane of the slot 23.

The principal design of the torque driver 20 provides the capacity for having both fixed and adjustable torque settings in a single embodiment. This design can be configured with use of the following design combinations, depending upon the application.

Combination A: if the load adjustment element knob 7 is not used or omitted as a part of the design, and a symmetrical locking detent 15 is used, then the number of available fixed settings is equal to the number of available driver spindle sockets 13.

Combination B: If the load adjustment element knob 7 is not used or omitted as a part of the design, and an asymmetrical locking detent 15*a* (FIG. 7) is used, then the number of available fixed settings is double the number of available driver spindle sockets 13.

Combination C: If the load adjustment element knob 7 is used for adjustments in steps 17 (discrete adjustment method shown in FIG. 9*a*), and the symmetrical locking detent 15 is used, then the number of available fixed settings is equal to the number of available driver spindle sockets 13 times the number of available steps of adjustment.

Combination D: If the load adjustment element knob 7 is used for adjustments in steps 17 (discrete adjustment method shown in FIG. 9*a*), and the asymmetrical locking detent 15*a* (FIG. 7) is used, then the number of available fixed settings is double the number of available driver spindle sockets 13 times the number of available steps of adjustment.

Combination E: If the load adjustment element knob 7 is used for stepless adjustments (continuous adjustment method), and either the symmetrical 15 or the asymmetrical locking detent 15*a* (FIG. 7) is used, then the number of available settings in a pre-determined adjustment range may be indefinite.

Combination F: If a driver arm 1*b* (FIG. 11) provides means for continuous adjustment of the distance between the driver spindle 11 and the force application spot 16, any of the above mentioned configurations provide an indefinite number of the torque settings in a pre-determined adjustment range.

Figure 2:
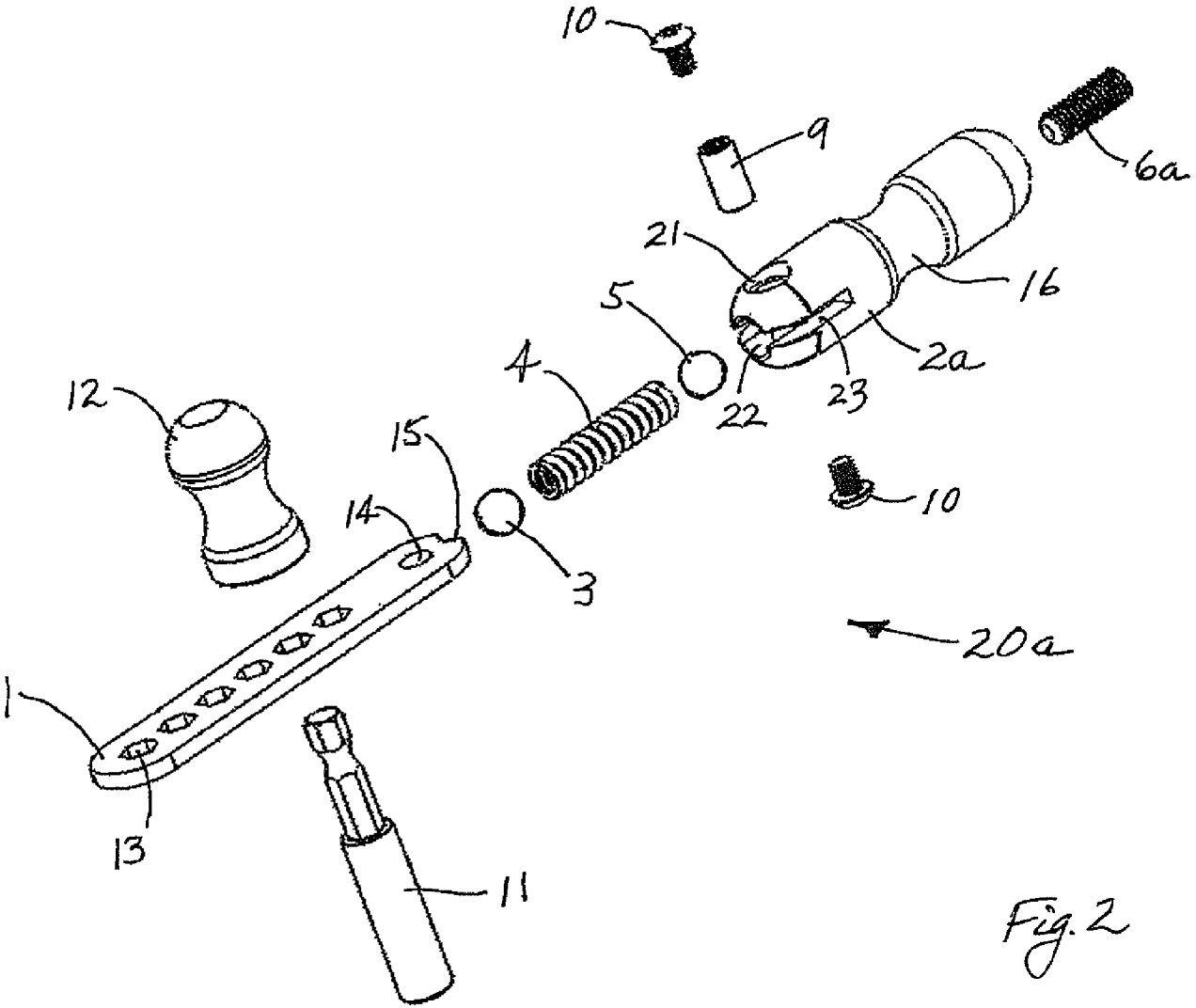
FIG. 2 is an exploded perspective view of a first alternate embodiment of the apparatus in FIG. 1.
Figure 3:
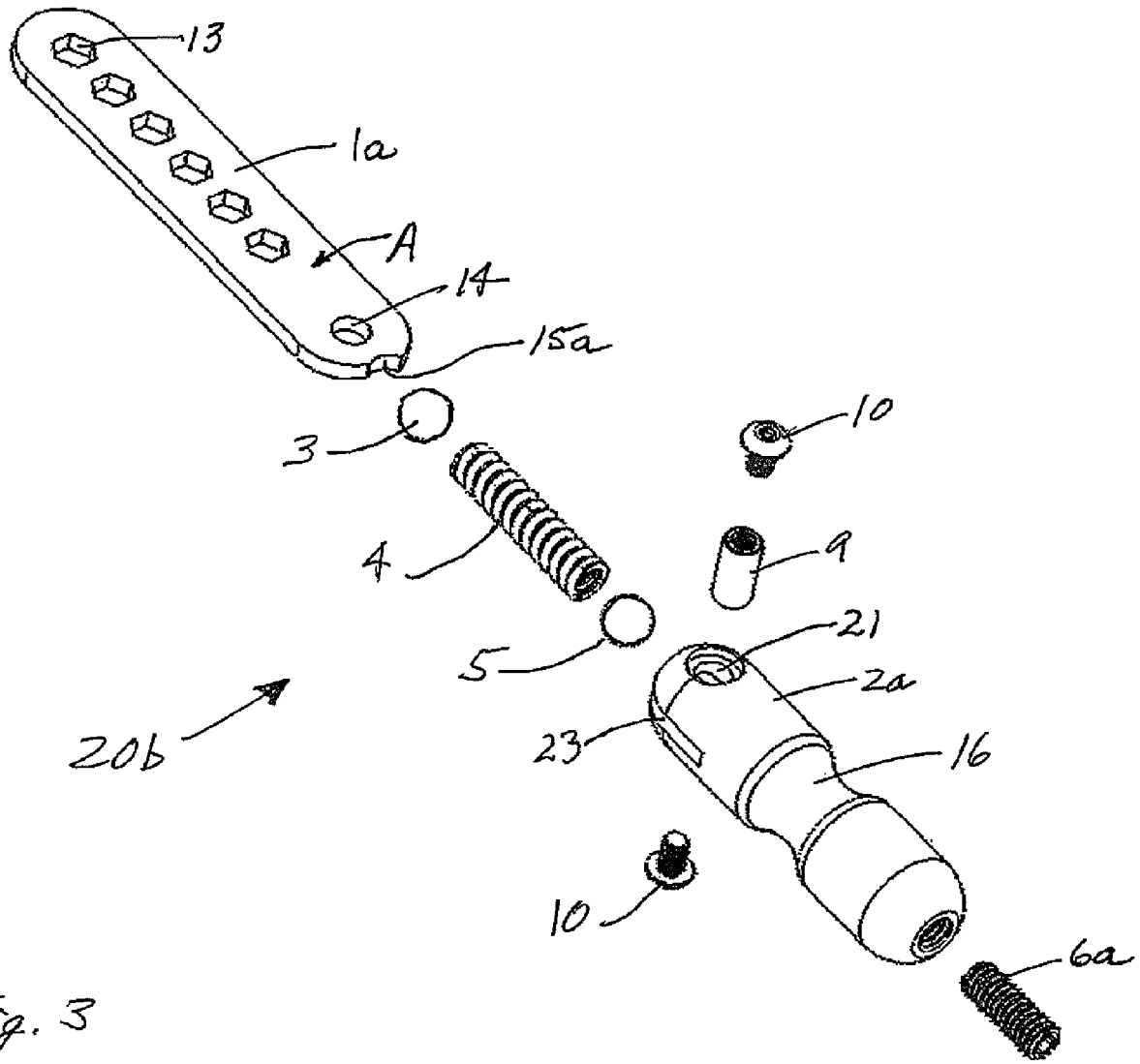
FIG. 3 is a an exploded perspective view of a second alternate embodiment of the apparatus shown in FIG. 1.

A first alternate embodiment 20*a* of the principal design without the adjustment element knob 7 and with the symmetrical locking detent 15 of the arm 1 is shown in FIG. 2. A second alternate embodiment 20*b* of the principal design without the adjustment element knob 7 and with an asymmetrical locking detent 15*a* of an arm 1*a* is shown in FIG. 3. The first alternate embodiment 20*a* is shown in FIG. 4 assembled for use.

The present invention also includes a method of limited torque fastener tightening by the steps of: providing a driver spindle 11; connecting the driver spindle to a driver arm 1 at a predetermined distance from a tightening force application spot of an arm handle 2; providing the handle with means of disengaging the connection with the arm 3, 15; engaging the driver spindle with an object to be rotated; applying a tightening force to the handle to rotate the arm and the driver spindle whereby the handle moves relative to the arm to prevent further application of the tightening force to the object upon being exposed to a pre-defined value of the tightening force.

The method of the invention determines that the selection of tightening torque values is accomplished by: a. mounting the driver spindle 11 onto the driver arm 1 at one of a plurality of predetermined distances 13, 24 from the force application spot 16 which corresponds to the desired tightening torque; or b. adjusting the pre-defined value required for disengagement between the handle and the arm (screw 6, knob 7); or c. use of the combination of both a. and b.

In addition, the method of the invention allows for the effective doubling of the number of torque settings by: a. use of the asymmetrically shaped locking detent in the arm which changes the value of the force required for disengagement of the arm and the handle; and b. mounting the driver spindle to the side of the arm which corresponds with the asymmetry of the locking detent.

The proposed design of the torque driver according to the invention allows for a wide adjustment of specified torque within the principal design. It is known that tightening fastener torque represents moment of force, defined by two factors: 1. applied force; and 2. arm of applied force, or distance from the center of driver rotation to the point of applied force, assuming that the force is applied in a tangential (normal) direction. Therefore, the proposed design incorporates means for the effective alteration of both of these factors in order to achieve a consistent and precise level of adjustability. Design factors providing adjustability of the fastener tightening torque are: a. depth of the locking detent 15, 15*a*; b. spring load applied to the locking element 3; c. location of the force application spot 16 in the handle 2, 2*a*; and d. position of the driver spindle mounting socket 13 of the arm 1, 1*a* relative to the force application spot 16 (effective arm length), or, alternatively, position of the driver spindle if means of continuous distance adjustment are used.

This invention allows the building of torque drivers of various configurations, in which all of these factors can be either fixed and non-adjustable by the user, or they can be made continuously adjustable and/or selectable from a number of fixed (pre-set) values by the user. It is important to mention, that such wide selection of the ways to adjust the tightening torque also allows for the building of the torque driver highly optimized for a specific application and cost, and capable of providing the best value for the user.

Figure 5:
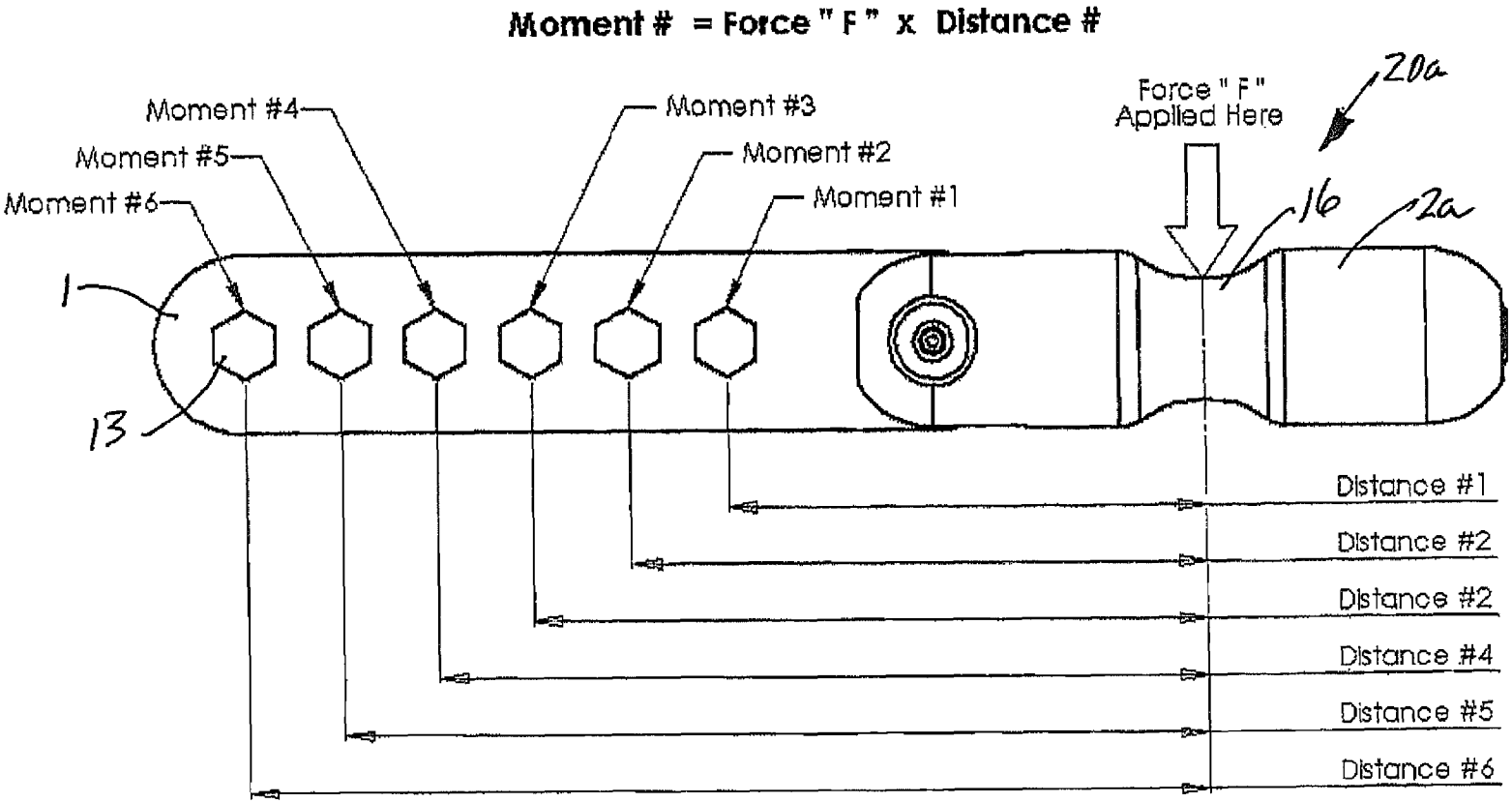
FIG. 5 is a plan view of the apparatus shown in FIG. 4 without the driver spindle and the driver spindle retaining knob, demonstrating the proposed method.
Figure 6A:
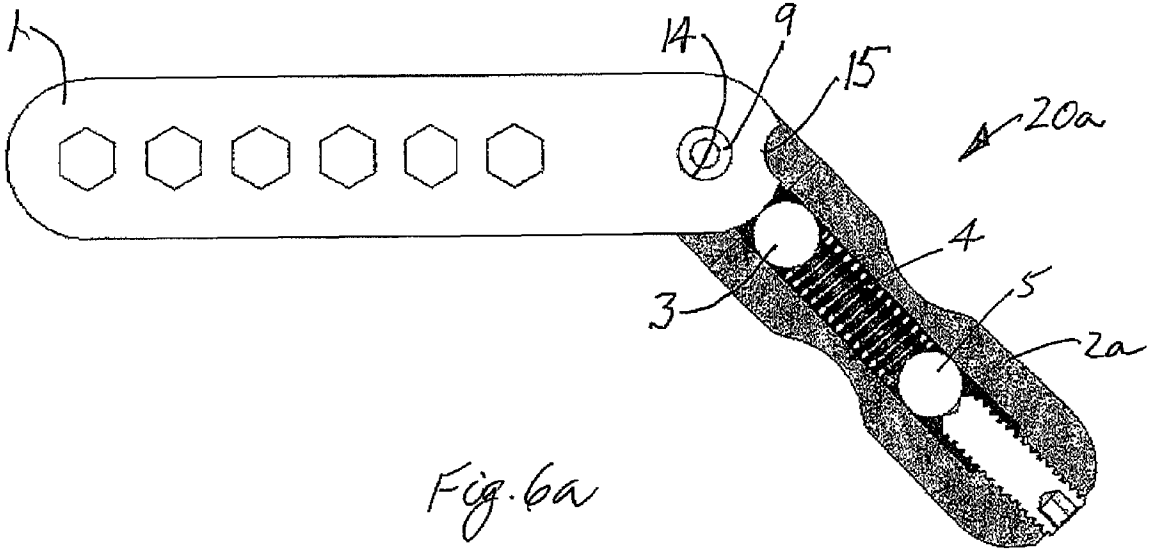
FIG. 6*a* is a view similar to FIG. 6 with the torque limit exceeded.

The principal design of the torque driver 20*a* in its simplest implementation as shown in FIGS. 5, 6 and 6*a* incorporates the following features associated with the four design factors mentioned above. The driver arm 1 has preset locations for at least two driver spindle mounting sockets, with six such sockets 13 creating six effective arm lengths. The symmetrical locking detent 15 of specified depth is located in the driver arm 1 at specified distance from the pivot 14. The spring load applied by the spring 4 onto the locking element 3 is preset by means of an adjustment screw 6*a* threaded into the smaller diameter portion 22*b* of the bore 22 in the handle 2*a* to engage the ball 5. The force application spot 16 on the handle 2*a* which is configured, as an example, in a shape of an ergonomic circular finger groove indicates to a user where to apply the tightening force. The driver spindle 11 with the holding knob 12 (FIG. 4) is attachable to both sides of the arm 1 (can be reversed from the position shown in FIG. 4) without a change in the torque setting.

Because this example of design has a fixed (preset) force at which the locking element disengages from the detent (FIG. 6*a*), the actual number of torque settings is determined by the number of available driver spindle mounting sockets, a total of six fixed settings, determined by availability of six effective arm lengths for the overall geometry of the physical driver arm as shown in FIG. 5.

Figure 7:
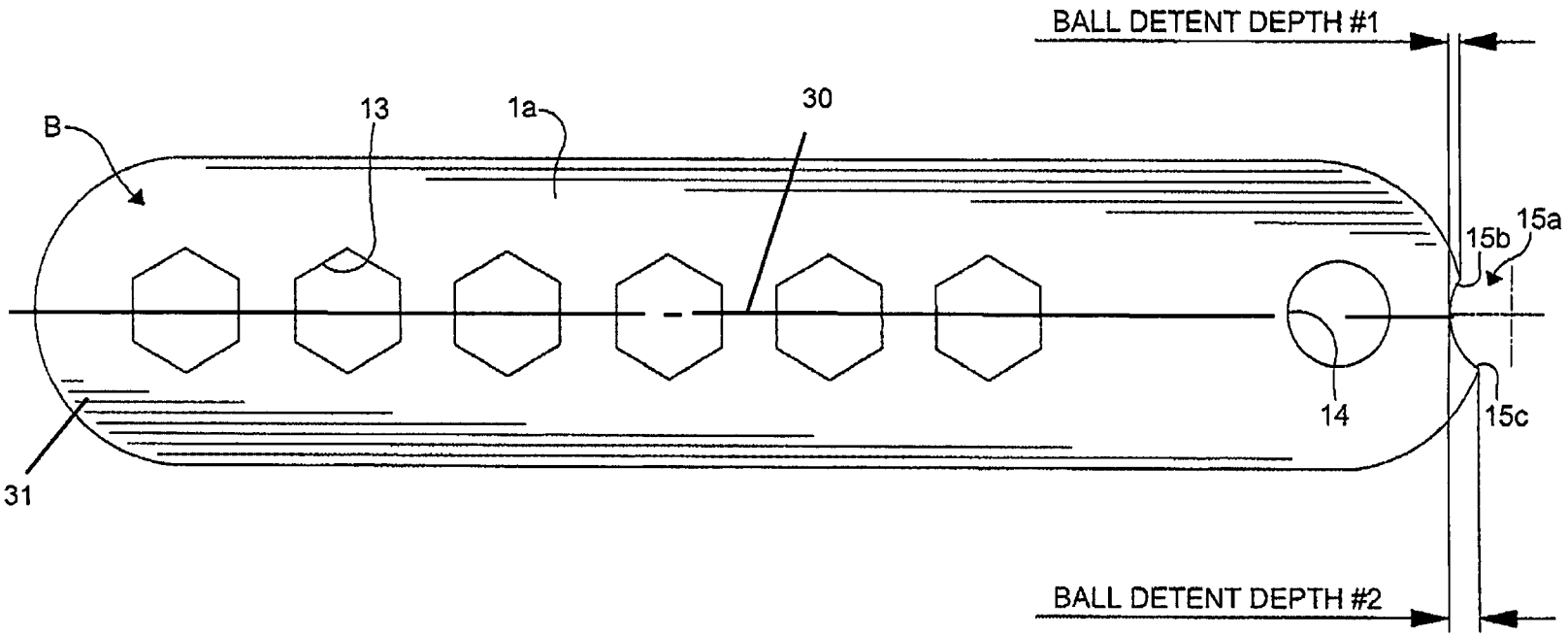
FIG. 7 is a plan view of the driver arm shown in FIG. 3.
Figure 8:
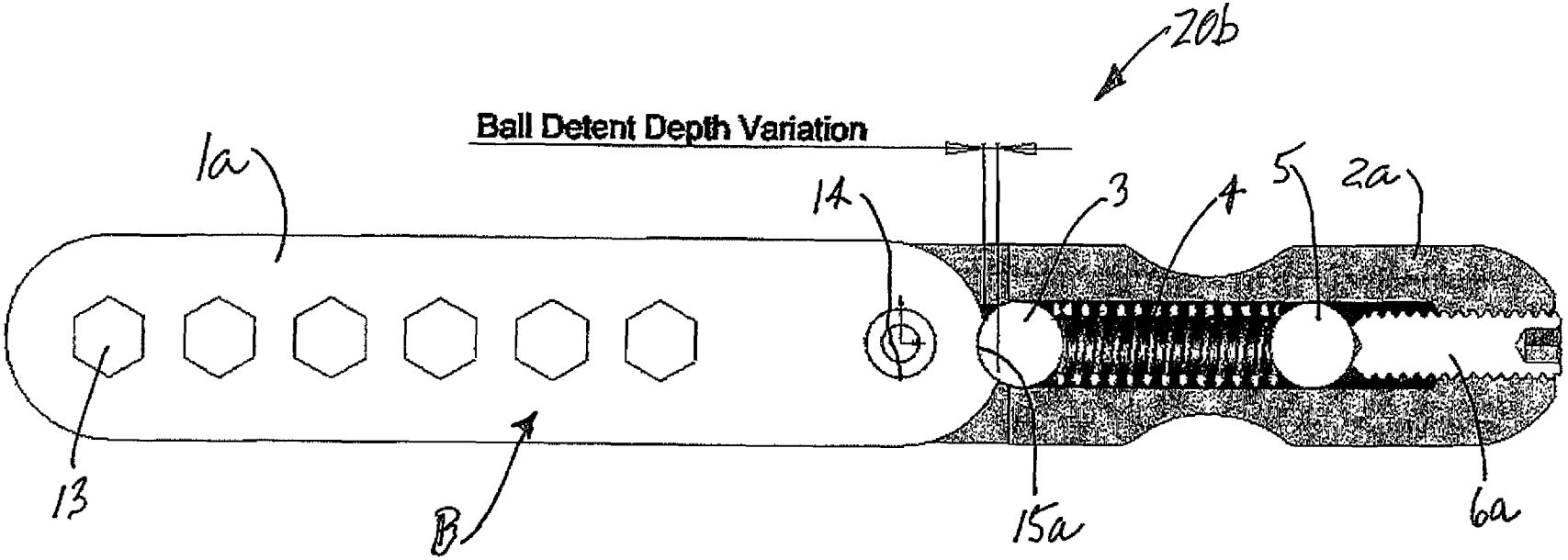
FIG. 8 is a plan view of the apparatus shown in FIG. 3 with the handle cut away.

The second alternate embodiment torque driver 20*b*, as shown in FIG. 3, includes a combination of the features mentioned above, except that the locking detent 15*a* has an asymmetrical shape (FIG. 7), which, in turn, forms a locking detent with two different effective depths, As shown in FIGS. 7 and 8, the detent 15*a* has a shorter length curved portion 15*b* and a longer length curved portion 15*c*. In combination with the fixed (preset) spring force, the variation in the locking detent depth allows the user to double the number of torque settings by selecting which side of the driver arm to use for attaching the driver spindle 11. Therefore, the driver design as shown (FIGS. 3, 7 and 8) has a total of twelve fixed settings—six of them when the driver spindle 11 is attached to arm side "A" (FIG. 3) and an additional six when the driver spindle is flipped over and attached to the driver arm side "B" (FIGS. 7 and 8).

Figure 9:
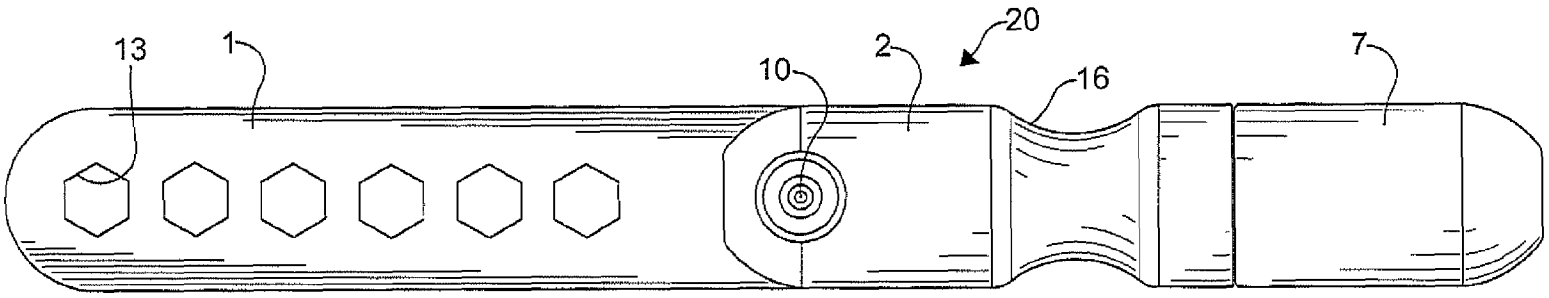
FIG. 9 is a plan view of the apparatus shown in FIG. 1 without the driver spindle and the driver spindle retaining knob.
Figure 9A:
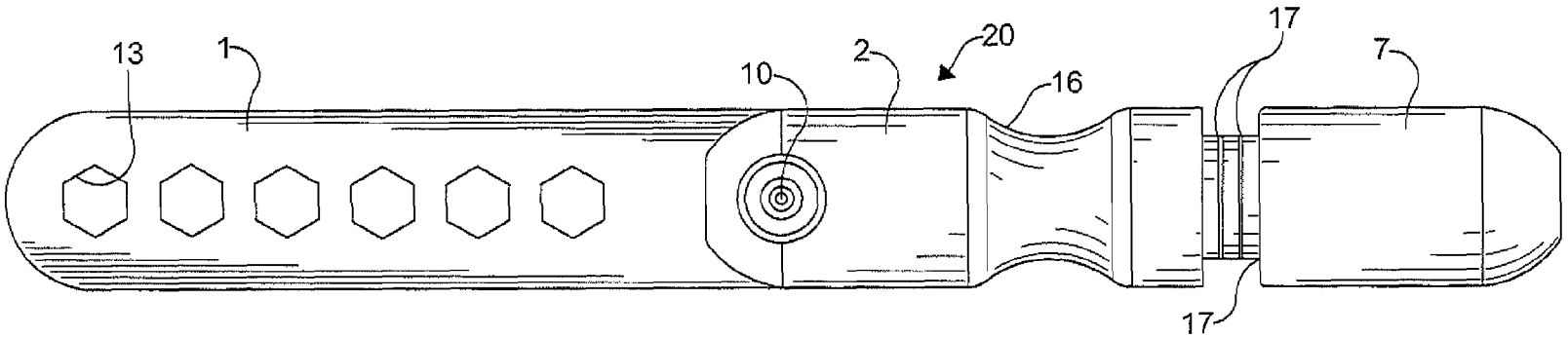
FIG. 9*a* is a view similar to FIG. 9 with the load adjustment knob in one of the reduced tightening force adjustment positions.
Figure 10:
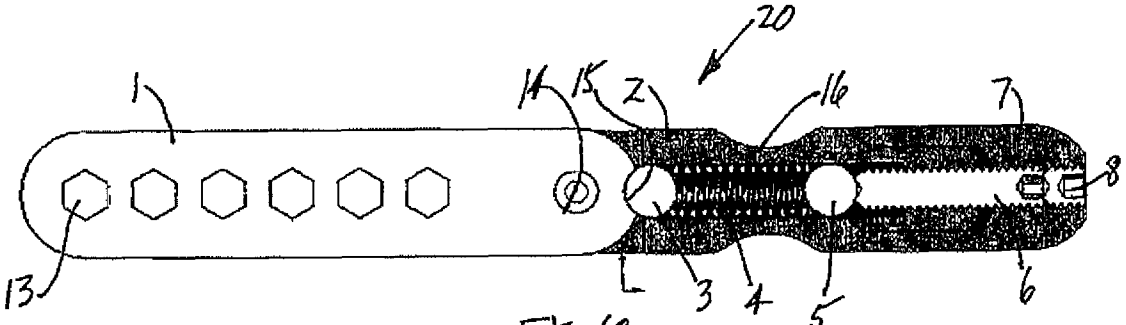
FIG. 10 is a view similar to FIG. 9 with the handle cut away.
Figure 10A:
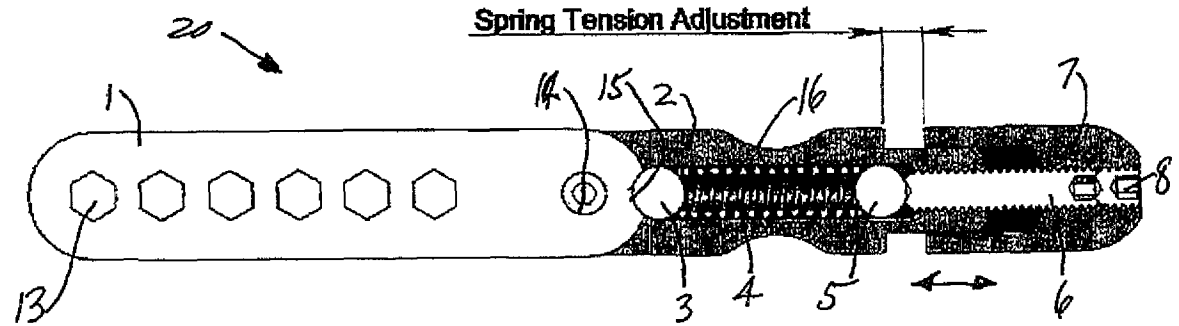
FIG. 10*a* is a view similar to FIG. 9*a* with the handle cut away.

The principle design with capability for adjustment by the user includes the addition of the handle knob 7 for direct spring load adjustment and is shown in FIGS. 1, 9, 9*a*, 10 and 10*a*. The screw 6 is threaded into the knob 7 and relative rotation between the two parts is prevented by the lock element screw 8 threaded into the knob 7 to engage the screw 6. By moving the adjustment screw 6 relative to the spring 4 through rotation of the knob 7, different spring loads can be achieved, which further expands a number of available torque settings. The driver handle 2 may have related scale markings 17 (FIG. 9*a*) to show offset of the adjustment knob 7 relative to the handle 2, which represents relative movement of the adjustment screw 6. As an example, FIG. 9*a* shows a design of the torque driver 20, which incorporates three circular markings 17, allowing the user to obtain three additional torque settings ranges of the six different torque values each, proportional to the six effective arm lengths and thus four obtainable presets of the spring force, for a total of twenty-four torque settings.

If desirable, the adjustment can be made continuous, by use of an appropriate marking scale, thus providing the torque driver with considerably more adjustment capabilities. In addition, and if desirable, this variation of a driver design can also incorporate the asymmetrical shape of the locking detent 15*a* (FIG. 7), further enhancing the available adjustment capabilities.

Figure 11:
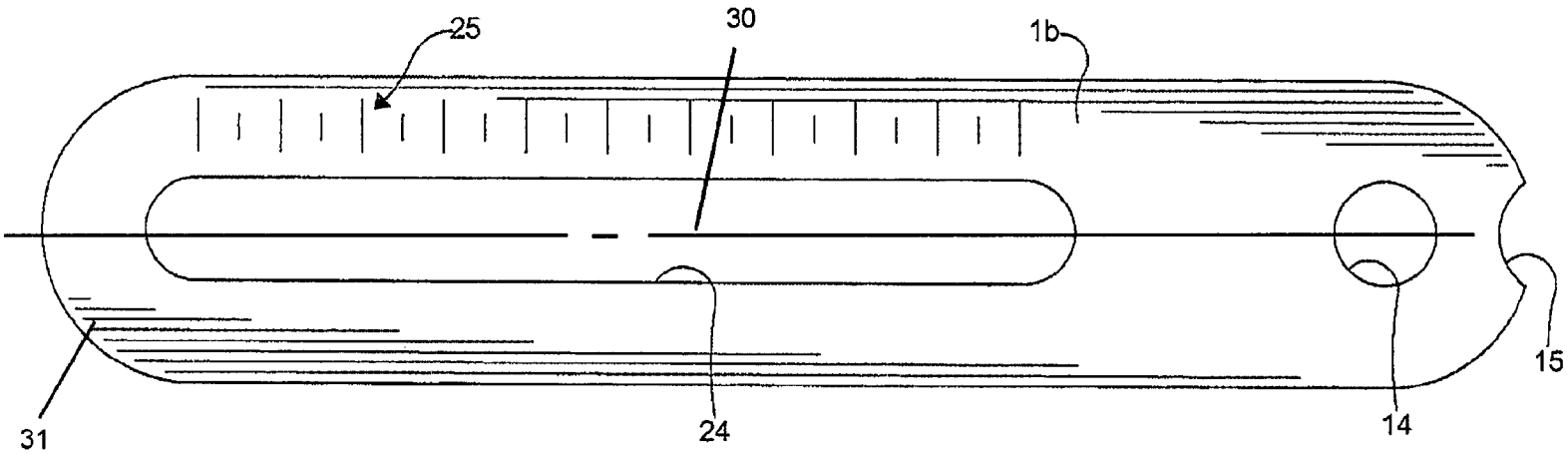
FIG. 11 is a plan view of the example of the driver arm with means for continuous distance adjustment

FIG. 11 shows an example of the driver arm 1*b*, which incorporates an elongated slot 24 extending from a free end of the arm toward the mounting hole 14. An associated adjustment scale formed of a plurality of scale markings 25 extends along one side of the slot 24. The slot 24 replaces the hex sockets 13. By moving the driver spindle 11 inside the slot 24, and then securing it in desired position, an indefinite number of torque settings in pre-determined adjustment range can be obtained. The driver arm 1*b* can incorporate both the symmetrical 15 and asymmetrical 15*a* shapes of the locking detent, depending upon application.

In the principal design, the locking element 3 is shown as a ball; however it can also be a roller or any other part of a suitable geometrical shape capable for performing the locking function in combination with an appropriately shaped detent. The coiled compression spring 4 is also shown as an example, while the actual design may incorporate instead any component capable of generating a specified axial force on the locking element 3, including, but not limited to, coiled and flat springs of other shapes, elastically deformed bushings or any other means. The curved shape of the locking detent 15, 15*a* is shown as an example, and is suitable for use with a ball as a locking element, but may have a V-shaped profile or any other profile appropriate to create a sufficient handle locking function. The driver arm 1, 1*a*, 1*b* incorporates a driver spindle mounting means that provides selective positioning of the driver spindle 11 relative to the force application spot 16. The driver arms 1 and 1*a* have the driver spindle mounting means in the form of at least two driver spindle sockets, six hex shaped spindle sockets 13 are shown as an example. However, any number of spindle mounting sockets of various shapes and configurations can be incorporated within the driver arm, and such sockets can be spaced apart from each other at any distances, even or uneven, to be determined by the application. In the alternative, the driver arm 1*b* has the driver spindle mounting means in the form of the elongated slot 24, such as the example shown in FIG. 11, for continuous adjustment of a single driver spindle mounting socket location relative to the force application spot, thus allowing the user to select a desired effective arm length most suitable for the application. Selection of various torque settings is provided by moving the driver spindle in the slot along the length of the slot, or by re-positioning the driver spindle from one socket to the other, which changes the distance between the driver spindle and the pivot mounting hole.

As shown in FIG. 7, a plurality of spaced apart spindle sockets 13 are positioned along a longitudinal axis 30 of the arm 1*a* between the pivot mounting hole 14 and a free end 31 of the arm forming a driver spindle mounting means. The spindle sockets 13 extend completely through the arm 1*a* transverse to the longitudinal axis 30. As shown in FIG. 11, the slot 24 is positioned in an elongated direction along the longitudinal axis 30 of the arm 1*b* between the pivot mounting hole 14 and the free end 31 of the arm forming a driver spindle mounting means. The slot 24 extends completely through the arm 1*b* transverse to the longitudinal axis 30. Thus, the distance between the free end 31 of the arm 1*a*, 1*b* and the pivot point at the pivot mounting hole 14 is maintained constant for all mounting positions of the driver spindle 11 along the arms 1*a* and 1*b*.

In accordance with the provisions of the patent statutes, the present invention has been described in what is considered to represent its preferred embodiment. However, it should be noted that the invention can be practiced otherwise than as specifically illustrated and described without departing from its spirit or scope.

What is claimed is:

1. A multi torque limiting driver apparatus comprising:

a driver arm having a pivot mounting hole formed adjacent one end, a free end opposite said one end and a driver spindle mounting means spaced from said pivot mounting hole extending completely through said driver arm transverse to a longitudinal axis of said driver arm for retaining a driver spindle, said driver spindle mounting means having at least two spaced apart mounting positions positioned along the longitudinal axis of said driver arm for retaining the driver spindle to transfer fastener tightening torque to a fastener, and a locking detent formed at said one end, wherein said driver mounting means is at least two spaced apart driver spindle sockets of common shape and size formed in said driver arm, each said socket being located at one of said at least two mounting positions;

a locking element engaging said locking detent;

a load applicator generating a selected load onto said locking element;

a handle having a finger groove formed therein, said handle being pivotally attached to said driver arm at said pivot mounting hole to maintain a constant distance between said free end and said pivot mounting hole wherein said finger groove is spaced from said pivot mounting hole and said at least two mounting positions are at different distances from said finger groove; and whereby said locking detent, said locking element and said load applicator cooperate to prevent relative movement between said driver arm and said handle when a tightening force applied at said finger groove is less than a pre-determined value and cooperate to permit relative movement between said driver arm and said handle when the tightening force applied at said finger groove is at said pre-determined value.

2. The apparatus according to claim 1 wherein said driver mounting means is an elongated slot having straight parallel sides formed in said driver arm and said at least two driver spindle sockets form opposite ends of said slot connected to said parallel sides, said slot retaining the driver spindle at a selected one of a plurality of mounting positions located in said slot between said parallel sides and between said opposite ends of said slot.

3. The apparatus according to claim 1 wherein said locking detent has an asymmetrical curved shape.

4. The apparatus according to claim 1 wherein said locking element is formed as a ball.

5. The apparatus according to claim 1 wherein said load applicator is a compression spring.

6. The apparatus according to claim 1 including a load adjustment element for selecting the load generated by said load applicator.

7. The apparatus according to claim 6 wherein said load adjustment element is a screw threaded into said handle.

8. The apparatus according to claim 6 including a load transfer element positioned between said load applicator and said load adjustment element.

9. The apparatus according to claim 8 wherein said load transfer element is formed as a ball.

10. The apparatus according to claim 1 including a pivot element mounted in said pivot mounting hole of said driver arm and extending into a handle pivot mounting hole formed in said handle.

11. The apparatus according to claim 1 wherein said handle has a slot formed therein retaining said one end of said driver arm.

12. The apparatus according to claim 1 wherein said handle includes scale markings and a rotatable knob for selective adjustment of the load generated by said load applicator.

13. The apparatus according to claim 1 wherein said driver mounting means is an elongated slot having straight parallel sides formed in said driver arm and including adjustment scale markings on said driver arm adjacent said elongated slot to assist in selecting a mounting position for a driver spindle.

14. A multi torque limiting driver apparatus comprising:

a driver arm having a pivot mounting hole formed adjacent one end, a free end opposite said one end and a driver spindle mounting means and extending completely through said driver arm transverse to a longitudinal axis of said driver arm for retaining a driver spindle spaced from said pivot mounting hole, said driver spindle mounting means having at least two different spaced apart mounting positions positioned along the longitudinal axis of said driver arm for retaining the driver spindle to transfer fastener tightening torque to a fastener, and a locking detent formed at said one end, wherein said driver mounting means is at least two spaced apart driver spindle sockets of common shape and size formed in said driver arm, each said socket being located at one of said at least two mounting positions;

a locking element engaging said locking detent;

a compression spring having a first end engaging said locking element and generating a selected load onto said locking element;

a load transfer element engaging a second end of said compression spring;

a handle having a finger groove formed therein, said handle being pivotally attached to said driver arm at said pivot mounting hole to maintain a constant distance between said free end and said pivot mounting hole wherein said finger groove is spaced from said pivot mounting hole and said at least two mounting positions are at different distances from said finger groove; and an adjustment screw engaging said load transfer element for selectively compressing said compression spring to select the load whereby said locking detent, said compression spring and said load applicator cooperate to prevent relative movement between said driver arm and said handle when a tightening force applied at said finger groove is less than a pre-determined value associated with the selected load and cooperate to permit relative movement between said driver arm and said handle when the tightening force applied at said finger groove is at said predetermined value.

15. The apparatus according to claim 14 wherein said driver mounting means is an elongated slot having straight parallel sides formed in said driver arm and said at least two driver spindle sockets form opposite ends of said slot connected to said parallel sides, said slot retaining the driver spindle at a selected one of a plurality of mounting positions located in said slot between said parallel sides and between said opposite ends of said slot.

16. The apparatus according to claim 14 wherein said handle has a longitudinally extending bore and said locking element, said compression spring, said load transfer element and said adjustment screw are positioned in said bore.

17. The apparatus according to claim 14 including a load adjustment knob threadably engaging said handle and said adjustment screw whereby rotation of said knob moves said adjustment screw to selectively change the load generated by said compression spring.

18. The apparatus according to claim 14 wherein said locking detent has an asymmetrical curved shape.

19. A multi torque limiting driver apparatus comprising:

a driver arm having a pivot mounting hole formed adjacent one end, a free end opposite said one end and a driver spindle mounting means spaced from said pivot mounting hole extending completely through said driver arm transverse to a longitudinal axis of said driver arm for retaining a driver spindle, said driver spindle mounting means having at least two spaced apart mounting positions positioned along the longitudinal axis of said driver arm for retaining the driver spindle to transfer fastener tightening torque to a fastener, and a locking detent formed at said one end wherein said locking detent has an asymmetrical curved shape;

a locking element engaging said locking detent;

a load applicator generating a selected load onto said locking element;

a handle having a finger groove formed therein, said handle being pivotally attached to said driver arm at said pivot mounting hole to maintain a constant distance between said free end and said pivot mounting hole wherein said finger groove is spaced from said pivot mounting hole and said at least two mounting positions are at different distances from said finger groove; and whereby said locking detent, said locking element and said load applicator cooperate to prevent relative movement between said driver arm and said handle when a tightening force applied at said finger groove is less than a pre-determined value and cooperate to permit relative movement between said driver arm and said handle when the tightening force applied at said finger groove is at said pre-determined value.

* * * * *